US010151174B2

(12) United States Patent
Allamon et al.

(10) Patent No.: US 10,151,174 B2
(45) Date of Patent: Dec. 11, 2018

(54) MULTI-FUNCTION SURGE REDUCTION APPARATUS

(75) Inventors: Jerry Allamon, Montgomery, TX (US); Kevin O. Trahan, The Woodlands, TX (US); Javier E. Bolivar, Spring, TX (US)

(73) Assignee: Allamon Properties LLC, Montgomery, TX (US)

( * ) Notice: Subject to any disclaimer, the term of this patent is extended or adjusted under 35 U.S.C. 154(b) by 1 day.

(21) Appl. No.: 13/542,593

(22) Filed: Jul. 5, 2012

(65) Prior Publication Data

US 2014/0008055 A1 Jan. 9, 2014

(51) Int. Cl.
*E21B 34/14* (2006.01)

(52) U.S. Cl.
CPC ..... *E21B 34/14* (2013.01)

(58) Field of Classification Search
CPC ..... E21B 34/14; E21B 34/06; E21B 33/12; E21B 34/00
USPC ..... 166/192, 193, 194, 332.4, 332.5, 334.1, 166/334.2, 334.4
See application file for complete search history.

(56) References Cited

U.S. PATENT DOCUMENTS

| | | | | |
|---|---|---|---|---|
| 3,750,752 | A * | 8/1973 | Mott | E21B 34/06 137/383 |
| 6,378,612 | B1 * | 4/2002 | Churchill | E21B 21/103 166/319 |
| 7,108,067 | B2 * | 9/2006 | Themig et al. | 166/317 |
| 2004/0000406 | A1 * | 1/2004 | Allamon et al. | 166/373 |
| 2006/0124317 | A1 * | 6/2006 | Telfer | 166/381 |
| 2006/0213670 | A1 * | 9/2006 | Bishop et al. | 166/386 |

* cited by examiner

*Primary Examiner* — Nicole Coy
*Assistant Examiner* — Kristyn A Hall
(74) *Attorney, Agent, or Firm* — Tumey L.L.P.

(57) ABSTRACT

A multi-function diverter tool is disclosed that allows positive-indication opening and closing of the tool in a downhole environment.

5 Claims, 4 Drawing Sheets

MULTI-FUNCTION SURGE REDUCTION APPARATUS

FIELD OF THE INVENTION

The invention pertains to multi-function (including openable and closeable) surge reduction tools for use in downhole environments.

BACKGROUND OF THE INVENTION

Casing is used in oil and gas well construction. In certain applications a string of casing may be deployed using a work string, for example, drill pipe, so that the casing string does not extend all of the way back to the drilling rig. These scenarios can include a liner and a sub-sea casing longstring.

A longstring is a string of casing whose upper end extends up to the wellhead. So a longstring used on a sub-sea well is one that does not extend up to the drilling rig once installed but whose top resides in the sub-sea wellhead which sits on the sea floor. A liner is a string of casing whose top end resides within the length of a previously installed casing string. The top end of a liner does not reside at surface or within a wellhead.

Both of these scenarios utilize drill pipe in order to deploy the casing string. It is known in the industry that the deployment a casing string may exert excessive pressure on an open formation. The excessive pressure may overcome the strength of the formation and thus cause the formation to break down and cause a cement job. Surge reduction tools exists that when used in conjunction with auto-fill float equipment allow the fluid that is being displaced from the well bore to move up the inside of the casing and deployment string, thus reducing the surge pressure. Specifically, the surge reduction tools divert fluid flow from the inside of the deployment string to the annular space above the casing string. Once it is determined that casing string must be washed down and or cemented then surge tool is closed so that the fluid flow is no longer diverted to the annular space above the casing. Reliable closing of the flow diversion is critical for ensuring successful cementing operations.

With the onset of dual gradient drilling methods a need exists which will require that a surge reduction tool begin in the closed position until it is deployed below the sea floor, then be allowed to open to allow fluid diversion from the inside to the annulus, and then be closed again to allow wash down or cementing operations.

It is possible that other applications may exist for this type of tool. It is also possible that applications exist requiring a tool to be opened and closed multiple times.

The present invention incorporates multiple shifting sleeves controlled by pressure enabled by sealing balls or plugging devices that land on seats and which shift the tool into an open or closed position. The seats then allow the ball or plugging device to be released through the tool. Proper sizing of the seats for balls or other plugging devices allows selective opening and closing of the tool, as well as allowing for a multi-stage tool that may be opened and closed repeatedly.

Additionally, the invention may incorporate a test sub that allows the work string to be pressure tested after the tool is closed, providing a positive indication to the surface that successful closure and sealing has occurred, and that further operations may proceed.

SUMMARY OF THE INVENTION

The invention provides a multiple-sleeve tool, in which each sleeve is provided with a respective landing device, or seat, for a plugging tool. (Plugging tools, such as darts or balls, are typically dropped from the surface and either fall or are pumped downhole.) As the tool is run downhole, it is in a closed position, preventing fluid communication between its exterior and its interior.

When the tool is in the desired position, it is opened by sending a first plugging device downhole to engage a landing seat. Because the tool provides multiple landing seats, the plugging device will be sized to pass through any up hole landing seats it may encounter until it reaches the desired one. Once the plugging device is sealingly engaged with the desired landing seat, pressure is used to release the sleeve associated with that landing seat, such as by shearable pins, screws, or rings, or other such pressure-releasable devices, thus shifting the sleeve downward.

In a preferred embodiment, the first such shifting action shifts a first sleeve into position so that holes in the sleeve body align with holes in the tool body, opening fluid communication between the exterior and interior of the tool.

In a similar manner, when it is desirable to again close and seal the tool, a second plugging device engages a second seat associated with a second sleeve. Upon increasing the work string fluid pressure, a second set of holding devices, such as shear screws, releases and allows the second sleeve to shift downward, closing off and sealing the fluid communication that was created by the shift of the first sleeve.

As those of skill in the art will recognize, multiple stages, each providing two such sleeves, can be "stacked" along a work string, either together or with desired separations between them, so that fluid diverter operations may be repeatedly opened and closed without the need to withdraw the work string from the wellbore.

Additionally, the invention provides for an optional test device comprising a yieldable seat, which yieldable seat can be sized to capture one or more of the plugging devices after they are released from the second sleeve seat(s). This test device allows the work string to be pressurized after the closing operation is completed, to test and insure that the closure occurred properly and that the device is sealed. After such testing, additional pressure may be used to release the plugging device and resume normal operations.

DETAILED DESCRIPTION

Figure 1A:
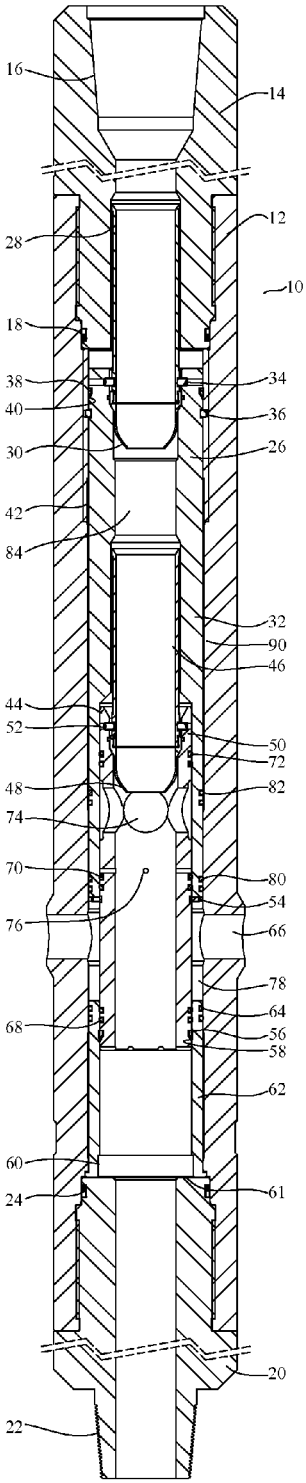
FIG. 1A is a sectional view of one embodiment of a tool of the present invention in the run-in position.

Referring to FIG. 1A, one embodiment of a tool of the present invention is shown in the run-in position. Multi-function diverter tool 10 comprises body 12, upper sub 14, lower sub 20, ports 66, and internal assemblies as described below. Upper sub 14 comprises upper threaded attachment 16 for connection to a work string, and upper body seal 18. Lower sub 20 comprises lower threaded attachment 22 for connection to a work string, and lower body seal 24.

Internal assemblies include upper slider assembly 26 and lower slider assembly 44. Upper slider assembly 26 comprises upper guide 28 connected to upper ball seat 30, and also connected to upper slider 32 by upper slider connector 34. Lower slider assembly 44 comprises lower guide 46 connected to lower ball seat 48, and also connected to lower slider 50 by lower slider connector 52. In a preferred embodiment, upper ball seat 30 is a larger diameter seat than lower ball seat 48.

In one embodiment of the invention, disassembly sleeve 62 is positioned above lower sub 20 and a sealing relationship with tool body 12 is provided by disassembly sleeve seals 64. Alternatively, disassembly sleeve 62 may be omitted and tool body 12 may be formed to provide the same shape as if disassembly sleeve 62 were in place. However, the addition of disassembly sleeve 62 provides greater ease in disassembly after recovery of the mult-function diverter tool 10, because it allows the internal portions of the tool 10 to slide out the bottom after removal of lower sub 20.

As seen in FIG. 1A, in the run-in position ports 66 are sealed away from the inner bore 84 by the sealing relationship provided by first upper slider seals 80, first lower slider seals 68, second lower slider seals 70, and disassembly sleeve seals 64. Once the tool 10 is in the desired position downhole, it may be opened to allow diversion of fluid from the inner bore 84 to the exterior of the tool 10.

Figure 1B:
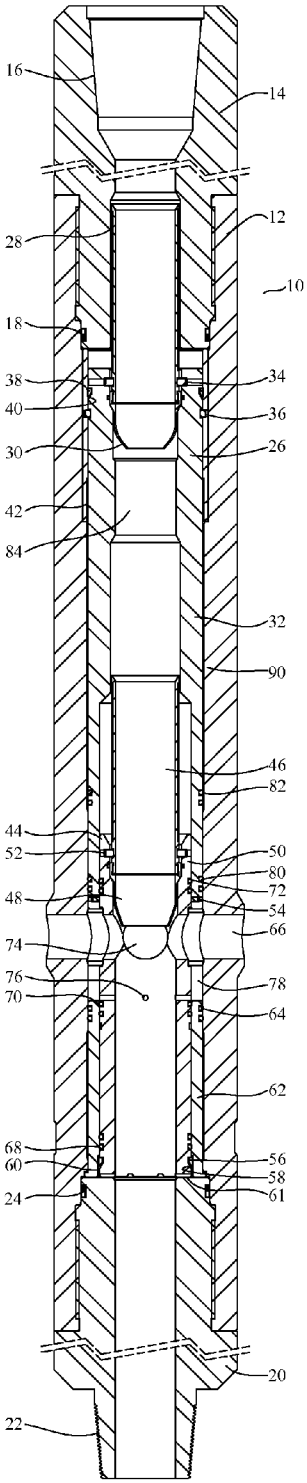
FIG. 1B is a sectional view of one embodiment of a tool of the present invention in the open position.

To open the tool 10 into the position shown in FIG. 1B a first ball (not shown) is dropped from the surface, and falls or is pumped downhole. The first ball is preferably of insufficient diameter to engage the upper ball seat 30, but of sufficient diameter to engage lower ball seat 48. Those of skill in the art will recognize that the first ball may engage upper ball seat 30 if it can be pumped through upper ball seat 30 at a pressure insufficient to shear upper shear screws 36.

Once the first ball is engaged on lower ball seat 48, pressure in the inner bore 84 is increased until lower shear screws 54 shear. Lower slider assembly 44 will the shift downward until lower slider 50 lands on landing 61 while upper slider 32 remains stationary. Lower latch ring 56 rides in lower latch ring groove 58 in lower slider 50. As lower slider 50 lands on landing 61, lower latch ring 56 reaches lower latch 60 and expands outward, thus engaging both lower latch ring groove 58 and lower latch 60. This action locks lower slider 50 relatives to disassembly sleeve 62 (or tool body 12), and prevents upward motion of lower slider assembly 44.

In the open position, ports 66 are aligned with lower slider windows 74. Once the first ball is pumped clear, the exterior of tool 10 is in fluid communication with inner bore 84, and the sides of the fluid pathway so provided are sealed by first upper slider seals 80, second lower slider seals 70, third lower slider seals 72, and disassembly sleeve seals 64.

Figure 1C:
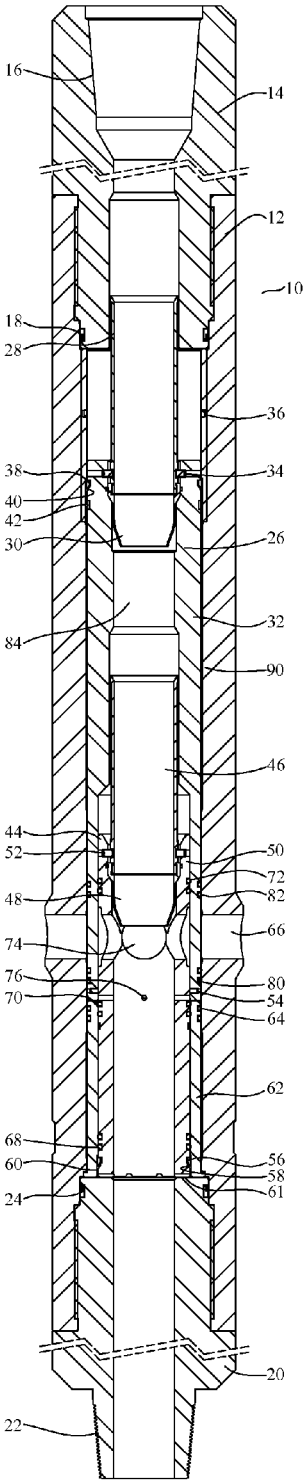
FIG. 1C is a sectional view of one embodiment of a tool of the present invention in the closed position.

To close the tool 10, for example to allow wash down and cementing operations, a second ball (not shown) is dropped from the surface, and falls or is pumped downhole. The second ball is of sufficient diameter to engage upper ball seat 30. Once the second ball is in position on upper ball seat 30, fluid pressure is increased to shear upper shear screws 36, allowing the upper slider assembly to shift downward until it reaches the position shown in FIG. 1C. Upper latch ring 38 rides in upper latch ring groove 40 until it reaches upper latch 42. At this point, upper latch ring 38 expands outward so that it engages both upper latch ring groove 40 and upper latch 42, preventing any upward shifting of upper slider assembly 26.

As upper slider assembly 26 shifts downward, any fluid trapped in outer annulus 78 is vented to the inner bore 84 via vents 76, preventing hydraulic locking of the tool.

In the closed position, ports 66 are isolated from the inner bore 84 by the sealing relationship between first upper slider seals 80, second upper slider seals 82, and tool body 12.

As those of skill in the art will recognize, it is possible to stack multiple stages of this invention by sizing upper and lower ball seats in each stage so that the ball seat diameter progressively increases going up the work string. In this way, the opening and closing operations can be repeated, stage by stage, as many times as desired or as space in the affected section of the wellbore allows.

Figure 2A:
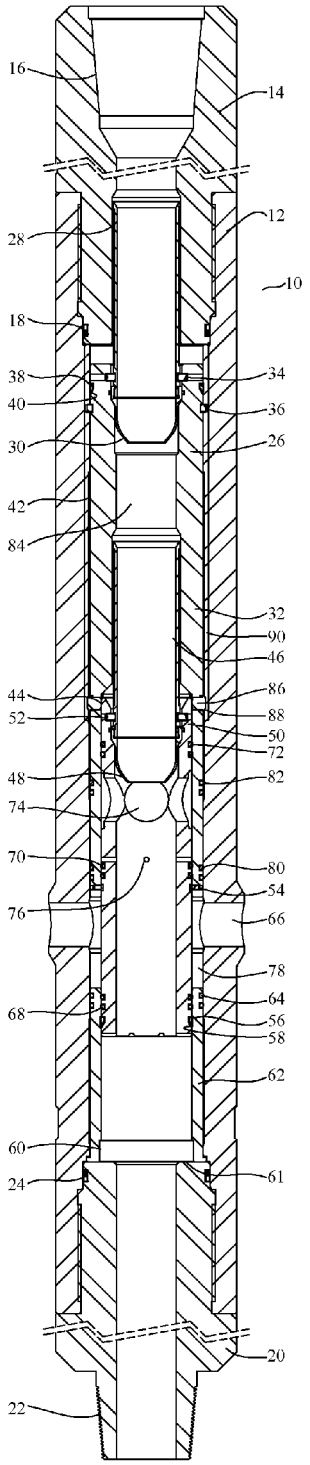
FIG. 2A is a sectional view of an alternative embodiment of a tool of the present invention in the run-in position.
Figure 2B:
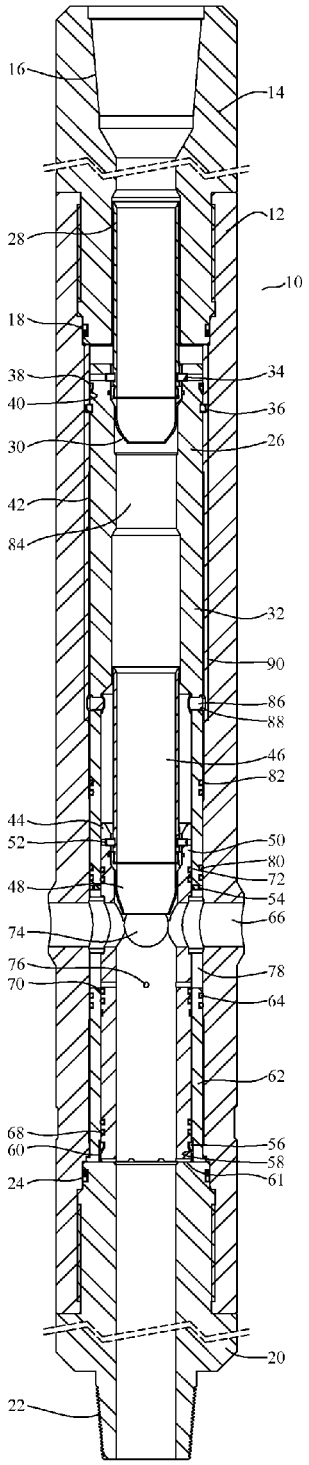
FIG. 2B is a sectional view of an alternative embodiment of a tool of the present invention in the open position.
Figure 2C:
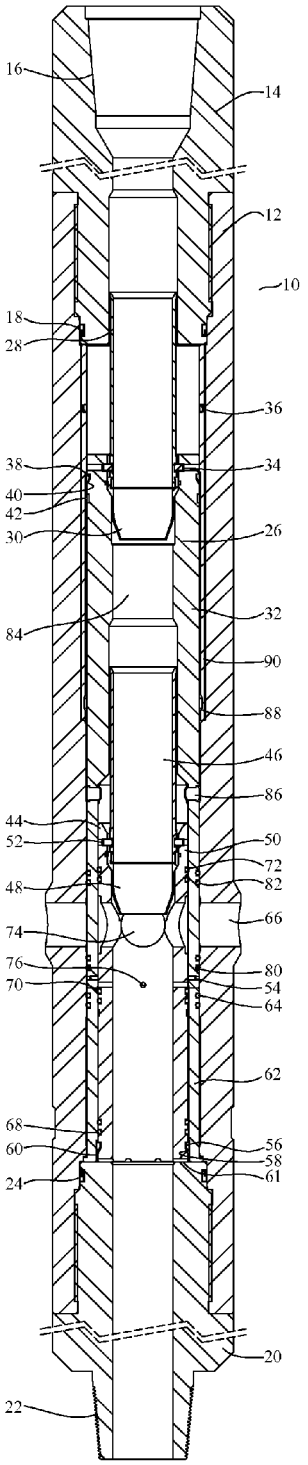
FIG. 2C is a sectional view of an alternative embodiment of a tool of the present invention in the closed position.
Figure 3:
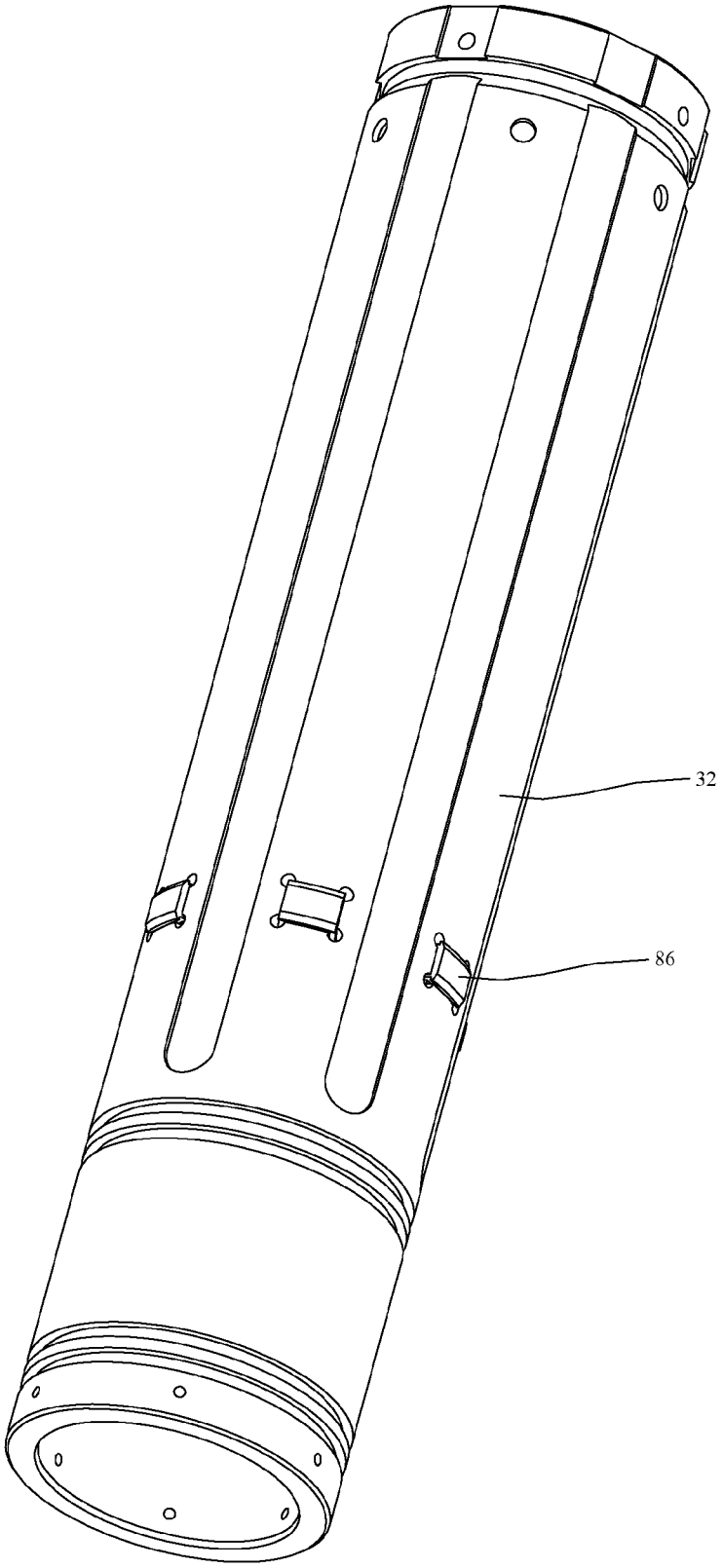
FIG. 3 is a perspective view showing the locking dogs of FIG. 2 in greater detail.

Referring to FIG. 2, an alternative embodiment of the present invention is shown. Upper slider 32 is radially penetrated by one or more locking dogs 86. Locking dogs 86 engages groove 88 in locking sleeve 90. In the run-in position (FIG. 2A), locking dogs 86 are prevented from inward movement because their inner surfaces engage lower slider 50. (A more detailed view of one embodiment of the locking dogs 86 is seen in FIG. 3, in which locking dogs 86 are shown extended through the body of upper slider 32.)

The presence of locking dogs 86 serves to lock upper slider 32 in position, preventing any loading of upper shear screws 36 until lower slider 50 has been shifted into the open position. (FIG. 2B). With lower slider 50 in the open position, locking dogs 86 are free to move inward, disengaging from locking sleeve 90 and allowing loading of upper shear screws 36. Upper shear screws 36 may then be sheared to move upper slider 32 and place the tool into the closed position. (FIG. 2C).

Figure 4:
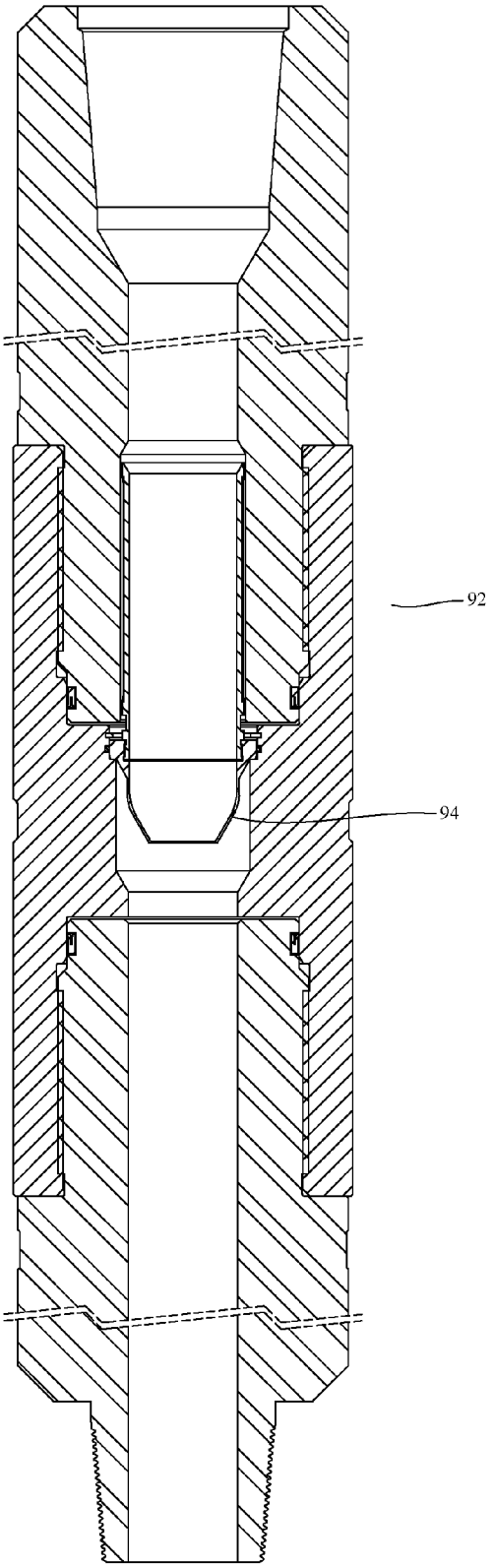
FIG. 4 is a sectional view of a test device mountable below a multi-function diverter tool of the present invention.

Referring to FIG. 4, in an additional embodiment of the invention, test sub 92 may be installed in the work string somewhere below a multi-function diverter tool 10 of the present invention. Yieldable ball seat 94 is sized to catch a ball (not shown) released from upper ball seat 30, which was used to shift the multi-function diverter tool 10 into the closed position. With the ball so caught, the work string may be pressure-tested to ensure that the multi-function diverter tool 10 has properly closed and is sealed. As those of skill in the art will recognize, when multiple multi-function diverter tools 10 are present in the work string, one or more test subs 92 may be used, depending on the sizing of the yieldable ball seat 94 and the operational requirements for the work string.

Those of skill in the art will recognize that the above descriptions are by way of example only, and do not serve to limit the scope of the invention as claimed below.

What is claimed is:

1. A diverter tool having a tool body including an interior and exterior for use in downhole operations, the divertor tool having an initial position preventing fluid communication from the interior of the tool to the exterior of the tool, a second position permitting fluid communication from the interior of the tool to the exterior of the tool, and a third position again preventing fluid communication from the interior of the tool to the exterior of the tool, further including one or more ports extending radially outwardly of the tool body a first sleeve axially movable within said tool body, wherein said first sleeve is selectively movable between said initial position and an open position, and wherein fluid communication between said interior and exterior of said tool body is precluded in said closed position and possible in said open position, a second sleeve axially movable within said tool body, wherein said second sleeve is selectively movable between a first position, and said second position, and wherein fluid communication between said interior and exterior of said tool body is possible in said first position and precluded in said second position, said second sleeve remaining stationary when said first sleeve is moved to the open position, means for selectively moving said first sleeve from said closed position to said open position, and means for selectively moving said second sleeve from said first position to said second position, and a disassembly sleeve positioned within the tool body, the first sleeve being partially disposed within the disassembly sleeve in the initial closed position.

2. The divertor tool of claim 1 further including means for locking said first sleeve in said open position.

3. The device of claim 1, additionally comprising a selectively releasable means for locking said second sleeve into position until after said first sleeve has been moved from said closed position to said open position.

4. The divertor tool of claim 1 wherein the second sleeve includes a solid positioned adapted to block fluid flow through the ports in the tool body in the third, closed position.

5. The divertor tool of claim 1 wherein the means for locking said first sleeve in said open position includes a lower latch ring on said first sleeve and a lower latch in said disassembly sleeve.

* * * * *